US009702629B2

(12) United States Patent
Forest

(10) Patent No.: US 9,702,629 B2
(45) Date of Patent: Jul. 11, 2017

(54) RETAINING BAR FOR HEAT FURNACE RECEPTACLES, HEAT FURNACE RECEPTACLE SUPPORTING ASSEMBLY COMPRISING RETAINING BAR AND HEAT FURNACE COMPRISING SAME

(71) Applicant: SPECTRIS CANADA INC., Montreal (CA)

(72) Inventor: Steve Forest, Quebec (CA)

(73) Assignee: SPECTRIS CANADA INC., Montreal, Quebec (CA)

( * ) Notice: Subject to any disclaimer, the term of this patent is extended or adjusted under 35 U.S.C. 154(b) by 164 days.

(21) Appl. No.: 14/388,698

(22) PCT Filed: Mar. 11, 2013

(86) PCT No.: PCT/CA2013/050176
§ 371 (c)(1),
(2) Date: Sep. 26, 2014

(87) PCT Pub. No.: WO2013/142989
PCT Pub. Date: Oct. 3, 2013

(65) Prior Publication Data

US 2015/0093712 A1 Apr. 2, 2015

Related U.S. Application Data

(60) Provisional application No. 61/616,573, filed on Mar. 28, 2012.

(51) Int. Cl.
*F27B 14/10* (2006.01)
*F27D 5/00* (2006.01)
*F27B 7/08* (2006.01)

(52) U.S. Cl.
CPC ..... *F27D 5/0018* (2013.01); *F27B 7/08* (2013.01); *F27D 5/0006* (2013.01)

(58) Field of Classification Search
CPC ..... F27D 3/02; F27D 3/12; F27D 5/00; F27D 5/0018; F27B 14/10; F27B 14/02; C30B 11/002; C30B 11/003; C30B 29/20
USPC ..... 432/157, 160, 162, 253, 259, 261, 262; 219/392; 266/161–165, 240, 245, 274, 266/275, 276; 220/23.83, 475, 535; 248/146–154, 156; 65/361; 414/798.2,
(Continued)

(56) References Cited

U.S. PATENT DOCUMENTS 797,121 A 8/1905 Keller
2,693,521 A * 11/1954 Alexander ..... C23C 14/243 118/726

(Continued)

*Primary Examiner* — Gregory A Wilson
(74) *Attorney, Agent, or Firm* — Eversheds Sutherland (US) LLP

(57) ABSTRACT

A retaining bar to be used in combination with a heat furnace supporting assembly for supporting at least one receptacle. The retaining bar comprises at least one single piece elongated body having a finite length and at least one receptacle receiving cavity defined therein and extending along a section of the length of the body. Each one of the at least one receptacle receiving cavity is configured to receive therein one of a bottom section and an upper section of one of the at least one receptacle. A heat furnace receptacle supporting assembly comprising such a retaining bar and a heat furnace provided with the heat furnace receptacle supporting assembly are further provided.

19 Claims, 6 Drawing Sheets

(58) Field of Classification Search
USPC ..... 414/267, 269, 288, 309, 331.03, 416.08, 414/749.5
See application file for complete search history.

(56) References Cited

U.S. PATENT DOCUMENTS

| | | | | | |
|---|---|---|---|---|---|
| 3,554,512 | A | | 1/1971 | Elliot et al. | |
| 4,023,523 | A | * | 5/1977 | Ing | C23C 14/243 118/726 |
| 4,308,009 | A | * | 12/1981 | Surachai | F27D 5/0037 432/11 |
| 4,612,042 | A | * | 9/1986 | Kelly | B22D 37/00 266/140 |
| 4,871,309 | A | * | 10/1989 | Chapman | G01N 1/44 432/156 |
| 4,911,638 | A | * | 3/1990 | Bayne | C30B 31/10 118/715 |
| 4,966,549 | A | * | 10/1990 | Ohdate | C30B 25/12 118/500 |
| 5,038,920 | A | * | 8/1991 | Nelson | B21D 43/055 198/774.4 |
| 5,315,091 | A | | 5/1994 | O'Brien et al. | |
| 6,454,564 | B2 | * | 9/2002 | Ricchio | C21D 9/0025 432/261 |
| 7,918,334 | B2 | * | 4/2011 | Gaetano | A23G 3/2023 198/867.11 |
| 2011/0140318 | A1 | * | 6/2011 | Reeves | B22D 11/103 266/215 |
| 2011/0154858 | A1 | | 6/2011 | Prossor | |
| 2013/0160704 | A1 | * | 6/2013 | LaFontaine | C30B 11/02 117/223 |

* cited by examiner

RETAINING BAR FOR HEAT FURNACE RECEPTACLES, HEAT FURNACE RECEPTACLE SUPPORTING ASSEMBLY COMPRISING RETAINING BAR AND HEAT FURNACE COMPRISING SAME

CROSS-REFERENCE TO RELATED APPLICATIONS

This application claims the benefit of U.S. Provisional Patent application No. 61/616,573 which was filed Mar. 28, 2012. The entirety of the aforementioned application is herein incorporated by reference.

TECHNICAL FIELD OF THE INVENTION

The present invention relates to the field of supports for heat furnace receptacles such as crucibles. More particularly, it relates to a retaining bar, a supporting assembly for at least one receptacle such as a crucible and a heat furnace comprising same, wherein the retaining bar and the supporting assembly support one or more receptacle and constrain their displacement.

BACKGROUND

The process of fusion generally consists of mixing an oxidized sample with a lithium borate flux and heating the mix to a temperature of approximately 1000° Celsius. At this temperature the flux melts and dissolves samples to form a perfectly homogenous mass. This homogenous mass is generally subsequently poured either into a preheated platinum mold to produce a glass disk for XRF analysis, or into an unbreakable beaker containing an acid solution to be analysed by atomic absorption (AA), inductively coupled plasma (ICP) or any traditional wet chemistry method.

Heating of the mix occurs in a heat furnace, such as a fluxer, where receptacles such as crucibles are supported by a pivotable supporting assembly having top, bottom, and side supporting members. The supporting assembly maintains a plurality of receptacles in predetermined positions during a rocking of the receptacles provided in the course of the heating process and a rotation leading to the pouring of the homogenous mass into the mold.

Common problems with known support assembly for such apparatuses are that the bottom supporting member often breaks prematurely as a result of creep resulting from the high heat and the flexural stress imposed on the bottom supporting member by the weight of the receptacles and their content, as well as thermal shocks. Another issue is that the heat furnace receptacles tend to move laterally left and right in response to the rocking movement and rotation of the support assembly.

One of the proposed solutions is to provide the bottom supporting member with lateral structures such as bushings, separated by sleeves to provide lateral support to the receptacles. This solution helps with the lateral movement issue; however it requires the assembly of multiple distinct pieces and results in a supporting member having an increased weight. In practice, it has been observed that the flexural stress imposed on the bottom supporting member, in this proposed solution, is such that the flexural stress often causes premature failure and breaking due to the effects of creep.

In view of the above, there is a need for an improved retaining bar and a heat furnace supporting assembly comprising the same which would be able to overcome or at least minimize some of the above discussed prior art concerns.

BRIEF SUMMARY

According to a general aspect, there is provided a retaining bar to be used in combination with a heat furnace supporting assembly for supporting at least one receptacle. The retaining bar comprises at least one single piece elongated body having a finite length and at least one receptacle receiving cavity defined therein and extending along a section of the length of the body. Each one of the at least one receptacle receiving cavity is configured to receive therein one of a bottom section and an upper section of one of the at least one receptacle.

In an embodiment, the elongated body comprises a plurality of evenly spaced-apart receptacle receiving cavities defined therein.

In an embodiment, the retaining bar is composed of non-reactive ceramics.

In an embodiment, the body of the retaining bar has a thickness ranging approximately between 0.1 and 50 millimeters.

In an embodiment, the body of the retaining bar has a thickness ranging approximately between 0.5 and 10 millimeters.

In an embodiment, the body of the retaining bar is thinner than wide in at least one section corresponding to the at least one receptacle receiving cavity.

In an embodiment, the at least one receptacle receiving cavity is configured to receive therein the bottom section of the at least one receptacle.

In an embodiment, the at least one receptacle receiving cavity is configured to receive therein the upper section of the at least one receptacle.

According to another general aspect, there is provided a heat furnace receptacle supporting assembly having a longitudinal axis for supporting at least one receptacle having a bottom section, a peripheral wall, and an upper section. The heat furnace receptacle supporting assembly comprises a first side supporting member and a second side supporting member extending along the longitudinal axis and spaced-apart from one another to receive the at least one receptacle therebetween. The heat furnace receptacle supporting assembly also comprises a retaining bar located between the first side supporting member and the second side supporting member and extending along the longitudinal axis. The retaining bar, the first side supporting member and the second side supporting member define together a receptacle receiving section. The retaining bar has an elongated body with at least one receptacle receiving cavity defined therein adapted to receive at least one of the bottom section and the upper section of a respective one of the at least one receptacle inserted in the receptacle receiving section. The first side supporting member and the second side supporting member are adjacent to the peripheral wall of the respective one of the least one receptacle inserted in the receptacle supporting section.

According to another general aspect, there is provided a heat furnace receptacle supporting assembly extending along a longitudinal axis for receiving at least one receptacle having a bottom section, a peripheral wall, and an upper section. The heat furnace receptacle supporting assembly comprises a first side supporting member and a second side supporting member extending along the longitudinal axis and spaced-apart from one another to receive the at least one receptacle therebetween. The heat furnace receptacle supporting assembly also comprises at least one retaining bar located between the first side supporting member and the second side supporting member and extending along the longitudinal axis. The combination of the at least one retaining bar, the first side supporting member and the second side supporting member defines a receptacle receiving section. Each one of the at least one retaining bar comprises a single piece elongated body with at least one receptacle receiving cavity defined therein adapted to receive one of the bottom section and the upper section of a respective one of the at least one receptacle received in the receptacle receiving section. The first side supporting member and the second side supporting member are adjacent to the peripheral wall of the at least one receptacle received in the receptacle receiving section.

In an embodiment, the at least one retaining bar extends below the first side supporting member and the second side supporting member.

In an embodiment, the at least one retaining bar is located below the at least one receptacle received in the receptacle receiving section.

In an embodiment, the heat furnace receptacle supporting assembly further comprises a top supporting member extending along the longitudinal axis above the first side supporting member and the second side supporting member and defining therewith the receptacle receiving section. The top supporting member extends above the at least one receptacle received in the receptacle receiving section.

In an embodiment, the heat furnace receptacle supporting assembly further comprises at least one bottom supporting member extending along the longitudinal axis and below the at least one receptacle received in the receptacle receiving section.

In an embodiment, the bottom section of the at least one receptacle received in the receptacle receiving section rests on the at least one bottom supporting member and is spaced apart from a bottom wall of a corresponding receptacle receiving cavity of the at least one retaining bar, the at least one retaining bar constraining longitudinal displacement of the at least one receptacle received therein.

In an embodiment, the at least one retaining bar extends above the first side supporting member and the second side supporting member. The heat furnace receptacle supporting assembly further comprises at least one bottom supporting member extending along the longitudinal axis below the first side supporting member and the second side supporting member and defining therewith the receptacle receiving section. The bottom section of the at least one receptacle received in the receptacle receiving section rests on the at least one bottom supporting member.

In an embodiment, the heat furnace receptacle supporting assembly further comprises at least one pivotal attachment plate to which the first side supporting member, the second side supporting member, and the at least one retaining bar are connected at an end thereof. Pivoting of the at least one pivotal attachment plate simultaneously pivots the first side supporting member, the second side supporting member, and the at least one retaining bar.

In an embodiment, the at least one pivotal attachment plate comprises two pivotal attachment plates, spaced-apart from one another, with the first side supporting member, the second side supporting member, and the at least one retaining bar extending therebetween and having an end operatively connected to a respective one of the two pivotal attachment plates. The two pivotal attachment plates pivot simultaneously.

In an embodiment, the at least one bottom supporting member is configured to support a weight of the at least one receptacle, such that a first lateral wall and a second lateral wall of each one of the at least one receptacle receiving cavity of the retaining bar constrain longitudinal movement of the bottom section of the at least one receptacle received therein while substantially no pressure is exerted on the retaining bar by the weight of the at least one receptacle.

According to another general aspect, there is provided a heat furnace for heating a sample contained in at least one receptacle having a bottom section and an upper section. The heat furnace comprises a heating chamber and a receptacle supporting assembly extending in the heating chamber along a longitudinal axis. The receptacle supporting assembly comprises at least two supporting members extending along the longitudinal axis and spaced apart from one another. The at least two supporting members define a receptacle receiving section and constrain displacement of the at least one receptacle received in the receptacle receiving section at least one of vertically and laterally. The receptacle supporting assembly further comprises a retaining bar extending along the longitudinal axis and having a single piece elongated body with at least one receptacle receiving cavity defined therein. Each one of the at least one receptacle receiving cavity is configured to constrain longitudinal displacement of a corresponding one of the at least one receptacle by receiving therein one of the bottom section and the upper section of the corresponding receptacle.

In an embodiment, the receptacle supporting assembly further comprises at least one attachment plate pivotally mounted in the heating chamber. The at least two supporting members and the retaining bar are connected to the at least one attachment plate at an end thereof.

In an embodiment, the at least one attachment plate is a single pivotable attachment plate and the receptacle supporting assembly is configured in a cantilever configuration.

In an embodiment, the at least one attachment plate comprises two pivotable attachment plates spaced-apart from one another, with the at least two supporting members and the retaining bar extending therebetween and having an end operatively connected to a respective one of the two pivotal attachment plates. The two pivotal attachment plates pivot simultaneously in the heating chamber.

In an embodiment, the at least two supporting members comprise a first side supporting member and a second side supporting member, spaced-apart from one another, and extending longitudinally adjacent to a peripheral wall of the at least one receptacle received in the receptacle receiving section.

In an embodiment, the at least two supporting members further comprise at least one bottom supporting member extending below the first side supporting member and the second side supporting member, at a lower end of the receptacle receiving section.

In an embodiment, the retaining bar extends at the lower end of the receptacle receiving section and the bottom section of the at least one receptacle received in the receptacle receiving section rests on the at least one bottom supporting member and is spaced apart from a bottom wall of a corresponding receptacle receiving cavity of the retaining bar. The retaining bar constrains longitudinal displacement of the at least one receptacle received therein.

In an embodiment, the at least two supporting members further comprise a top supporting member extending above the first side supporting member and the second side supporting member, at an upper end of the receptacle receiving section.

In an embodiment, the retaining bar is located at the lower end of the receptacle receiving section.

In an embodiment, the retaining bar is located at an upper end of the receptacle receiving section.

BRIEF DESCRIPTION OF THE DRAWINGS

Other objects, advantages and features of the present invention will become more apparent upon reading the following non-restrictive description of preferred embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are preferred embodiments only, given solely for exemplification purposes.

Moreover, although the preferred embodiment of the retaining bar and the heat furnace supporting assembly, and the corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the retaining bar and the heat furnace supporting assembly, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
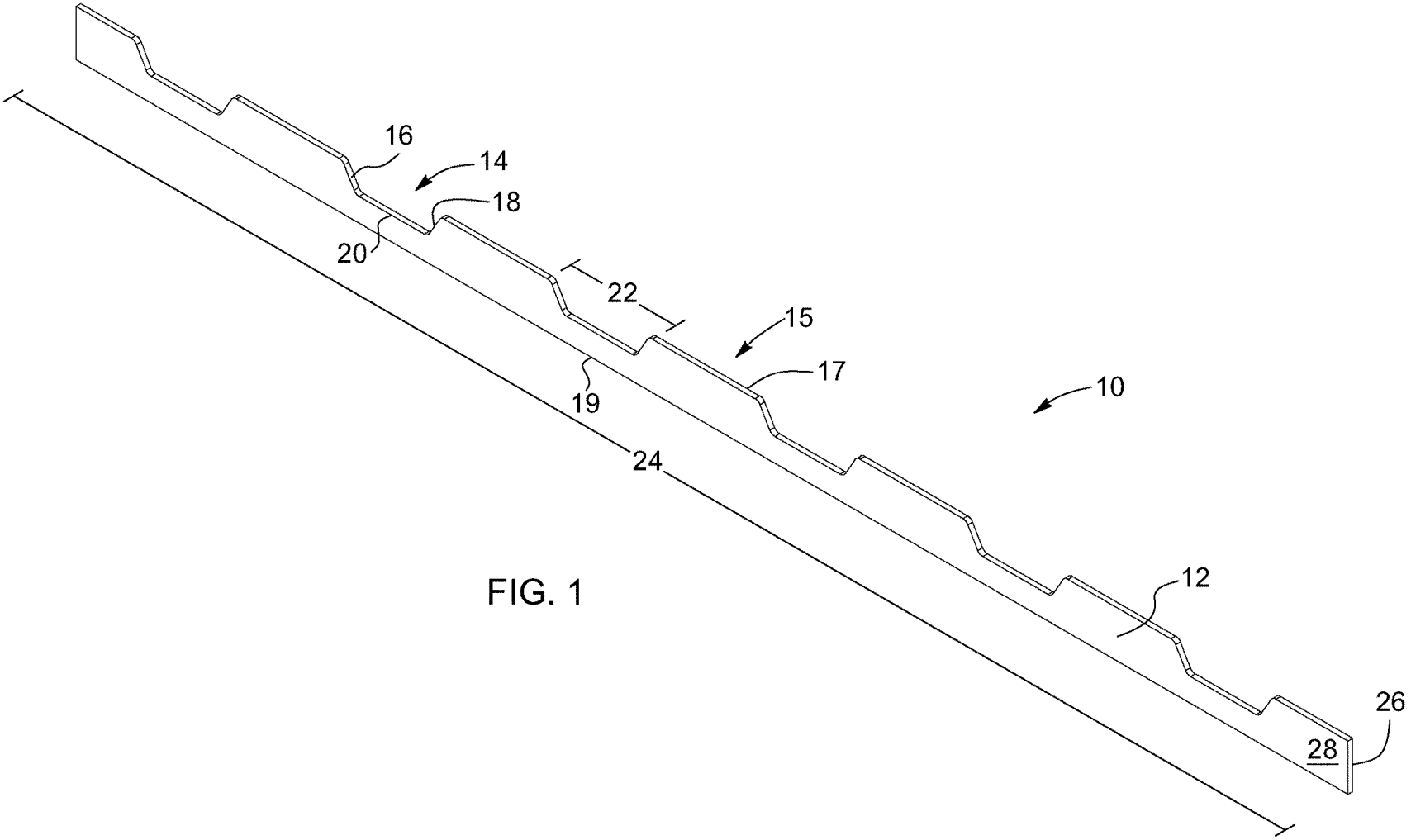
FIG. 1 is a perspective view of a retaining bar for heat furnace receptacles, in accordance with an embodiment.

Referring to FIG. 1, there is shown an embodiment of a retaining bar 10 for heat furnace receptacles 30 (see FIG. 2) such as crucibles. The retaining bar 10 has a single piece elongated body 12 extending over a finite length 24 corresponding substantially to the length of the corresponding supporting assembly 40, 140 (see FIGS. 2 and 7), which will be described later. At least one receptacle receiving cavity 14, or depression, is formed along the length 24 of the body 12 of the retaining bar 10. Each receptacle receiving cavity 14 extends along a section of the body 12 and has a finite length 22, shorter than the length 24 of the body 12.

Each receptacle receiving cavity 14 is defined by a first lateral wall 16 and a second lateral wall 18, spaced-apart from the first lateral wall 16 and joined together by a bottom wall 20. The first lateral wall 16 and the second lateral wall 18 are located on opposite lateral extremities of the receptacle receiving cavity 14 and form a recess within the body 12 of the retaining bar 10, the recess extending up to the bottom wall 20. In the illustrated embodiment, the first lateral wall 16 and the second lateral wall 18 are outwardly angled (i.e. outwardly oblique angles), however, one skilled in the art will understand that in alternative embodiments the first lateral wall 16 and the second lateral wall 18 could present different configurations. For instance and without being limitative, the first lateral wall 16 and the second lateral wall 18 could extend substantially parallel to one another and/or the first lateral wall 16 and the second lateral wall 18 could define right angles with the bottom wall 20.

One skilled in the art will understand that even though the retaining bar 10 is illustrated in FIG. 1 in a configuration where the receptacle receiving cavities 14 extend downwardly into the body 12 of the retaining bar 10, in an alternative embodiment, the retaining bar 10 may be used in an inverted configuration where the receptacle receiving cavities 14 extend upwardly into the body 12, as can be seen, for example in FIG. 7, which will be described in more details below.

The receptacle receiving cavities 14 are bordered on each opposite sides by separation sections 15 presenting an upper surface 17. The separation sections 15 and the receiving cavities 14 are configured in an alternate configuration. The upper surface 17 of each separation section 15 is located at a greater distance from a downward surface 19 of the retaining bar 10 than the bottom walls 20 of the adjacent receptacle receiving cavities 14. In other words, the retaining bar 10 is wider in the separation sections 15 than in the receiving cavities 14. One skilled in the art will understand that, even though the upper surface presents a substantially flat configuration in the illustrated embodiment, in alternative embodiments, the upper surface 17 could present different configurations such as, without being limitative, a curved or a wavy configuration. In an alternative embodiment, the separation section 15 could even be a single peak between adjacent receptacle receiving cavities 14, as long as the adjacent separation sections 15 define the receiving cavities 14 inbetween.

As can be seen in FIG. 1, multiple receptacle receiving cavities 14 can be formed along the length 24 of the body 12 of the retaining bar 10. The amount of receptacle receiving cavities 14 corresponds to the amount of receptacles that can be simultaneously supported by the supporting assembly 40 comprising the retaining bar 10. Therefore, in the non-limitative embodiment shown in FIG. 1, the retaining bar 10 is designed to receive six receptacles, i.e. it is designed to be used in a six receptacles supporting assembly 40. In alternative embodiments, the retaining bar 10 can include more or less receptacle receiving cavities 14. Therefore, one skilled in the art will understand that even though the present description usually refers to a plurality of receptacles and a plurality of receptacle receiving cavities 14 formed in the body 12 of the retaining bar 10, this should not be considered limiting and the teachings also apply to a similar receptacles supporting assembly 40 for a single receptacle.

In the illustrated embodiment, the receptacle receiving cavities 14 are evenly distributed along the length 24 of the body 12 of the retaining bar 10. However, one skilled in the art will understand that the distance between each receptacle receiving cavity 14 does not need to be constant and could differ between each receptacle receiving cavity 14, as long as the distance between adjacent receptacle receiving cavities 14 is sufficient for the corresponding receptacles disposed in consecutive receiving cavities 14 not to interfere with one another.

Figure 3:
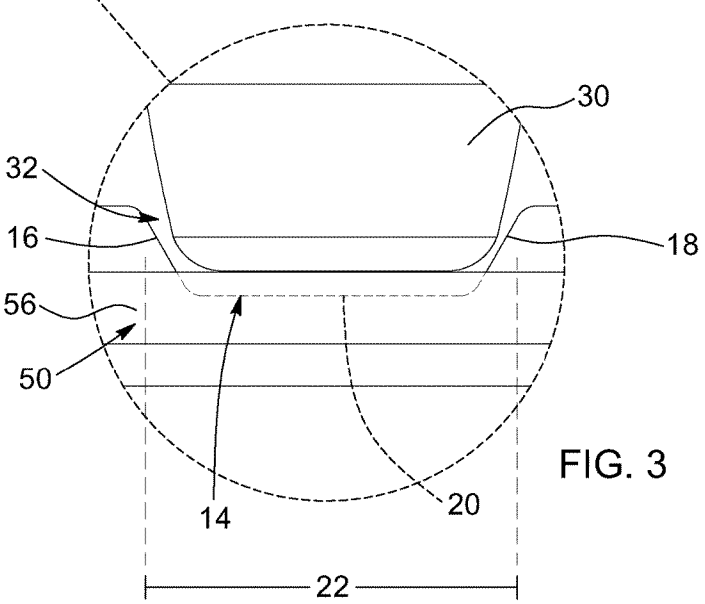
FIG. 3 is an enlarged view of a section of the heat furnace supporting assembly of FIG. 2.

Now referring to FIG. 3, in an embodiment each one of the receptacle receiving cavities 14 is configured such that a bottom section 32 of a corresponding heat furnace receptacle 30 can be at least partially inserted therein. In an embodiment, the length 22 between the first lateral wall 16 and the second lateral wall 18 is greater than the diameter of the bottom section 32 of the corresponding heat furnace receptacle 30, to allow the bottom section 32 to be lowered into the receptacle receiving cavity 14 and allow its bottom surface to lie proximal to the bottom wall 20 of the receiving cavity 14. The assembly for supporting the bottom surface of the receptacle 30 proximal to the bottom wall 20 of the receiving cavity 14 will be described below. When the bottom section 32 of the heat furnace receptacle 30 is lowered into the receptacle receiving cavity 14, the first lateral wall 16 and second lateral wall 18 provide longitudinal support to retain the heat furnace receptacle 30 and constrain longitudinal displacement, i.e. displacement towards an adjacent heat furnace receptacle 30 along the longitudinal axis. The heat furnace receptacle can be any container capable of receiving the mix therein, such as without being limitative a crucible, a beaker, or the like.

Figure 7:
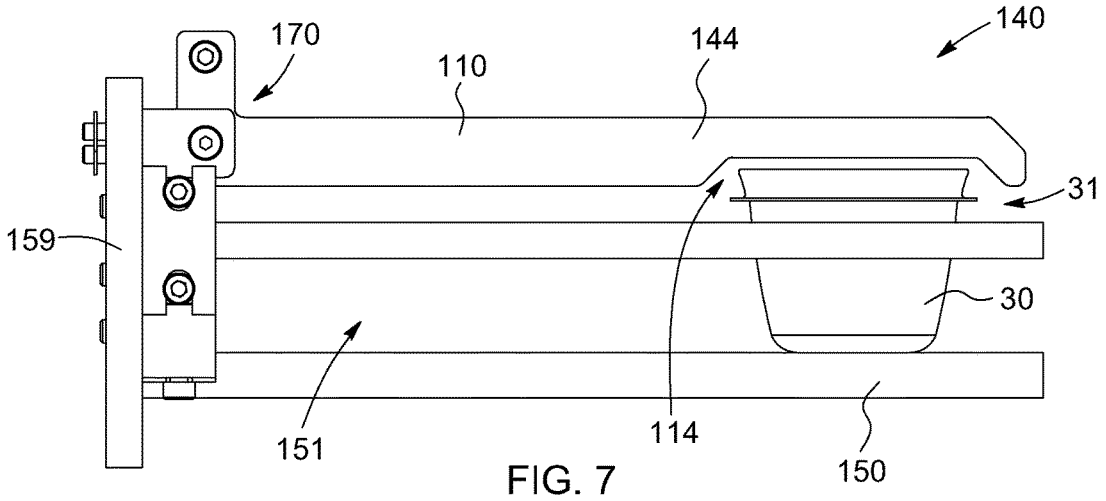
FIG. 7 is a front elevation view of a heat furnace supporting assembly, in accordance with an embodiment where the components are supported in a cantilever configuration and the retaining bar is provided above the heat furnace receptacle.

In an alternative embodiment and as can be seen for example in FIG. 7, the retaining bar 110 could be positioned above the receptacle 30. In this embodiment, each one of the receptacle receiving cavities 114 is configured such that an upper section 31 of a heat furnace receptacle 30 can be at least partially inserted therein.

In an embodiment, the retaining bar 10 is made of a non-reactive material which offers sufficient mechanical support at temperatures that can go over 1200° Celsius and can resist thermal shocks associated with heat of this magnitude. For example, and without being limitative, the retaining bar 10 can be made of a material composed of non-reactive ceramics such as, without being limitative, alumina ($Al_2O_3$) or zirconium ($ZrO_2$). However, one skilled in the art will understand that other materials having the above mentioned characteristics could be used.

As can be seen in FIG. 1, in an embodiment, the body 12 of the retaining bar 10 presents a substantially rectangular cross section having a relatively thin thickness. In an embodiment, the thickness of the bar ranges from approximately 0.1 to 50 millimeters. In an alternative embodiment, the thickness of the bar ranges from approximately 0.5 to 10 millimeters. One skilled in the art will understand that, in alternative embodiments, bars with a greater or lower thickness can be provided. The substantially rectangular cross section of the body 12 of the retaining bar 10 results from the first side wall 26 and the second side wall 28 of the body 12 of the retaining bar 10 being substantially flat. However one skilled in the art will understand that, in an embodiment, different configurations of the first side wall 26 and second side wall 28 could be provided, such as without being limitative a curved configuration, a wavy configuration, or the like. In an alternative embodiment, the retaining bar 10 could be made of a plurality of adjacent bars, spaced-apart from one another or juxtaposed, extending substantially parallel to one another, evenly leveled, and configured such that their receptacle receiving cavities 14 are aligned (or in register) with one another. Each one of the elongated body (ies) defining the retaining bar 10 is a single piece along the longitudinal axis. In an embodiment, the receiving bar 10 is thinner than wide in the sections of the receiving cavities 14, i.e. the distance between the downward surface 19 and the bottom wall 20 is greater than the thickness of the receiving bar 10.

In an embodiment the receptacle receiving cavities 14 are cut in the retaining bar 10 using laser cutting technology, in order to provide precise cutting of the retaining bar 10 without affecting the flexural strength. Once again, one skilled in the art will understand that other known methods could be used for cutting the receptacle receiving cavities 14 in the retaining bar 10.

Now referring to FIGS. 2 to 5, the retaining bar 10 is designed to be part of a heat furnace supporting assembly 40 extending along a longitudinal axis, which is substantially horizontal. The heat furnace supporting assembly 40 supports the receptacles 30 and holds the receptacles 30 in place during the pivotal movement associated with the rocking of the receptacles 30, if any, during the heating process, and the pouring of the resulting homogenous mass onto the corresponding molds 52. A receptacle receiving section 51 is provided between the different components of the heat furnace supporting assembly 40. When receptacles 30 are received in the heat furnace supporting assembly 40, they are located within this receptacle receiving section 51. In other words, the components of the heat furnace supporting assembly 40 define an open cage like structure with an inner spacing forming the receptacle receiving section 51 in which the receptacles 30 are received.

Figure 8:
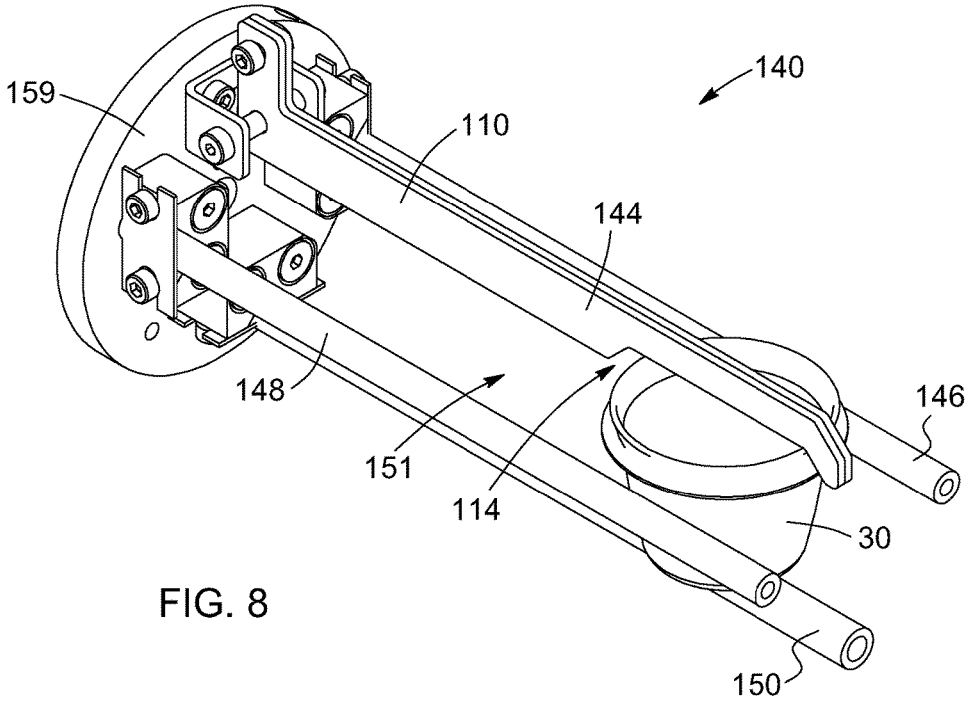
FIG. 8 is a perspective view of the heat furnace supporting assembly of FIG. 7.

Referring to FIGS. 7 and 8, there is shown an alternative embodiment of the heat furnace supporting assembly 40 wherein the features are numbered with reference numerals in the 100 series and which correspond to the reference numerals of the previous embodiment.

Referring to FIGS. 2 to 5 and 7 to 8, the heat furnace supporting assembly 40, 140 comprises a first side supporting member 46, 146 and a second side supporting member 48, 148 extending along the longitudinal axis. The first side supporting member 46, 146 and the second side supporting member 48, 148 extend on opposite sides of the receptacle receiving section 51, 151 and are proximal to the peripheral walls of each receptacle 30 when the receptacles 30 are positioned within the receptacle receiving section 51, 151. The first side supporting member 46, 146 and the second side supporting member 48, 148 extend substantially parallel to one another. One skilled in the art will understand that the term <<substantially parallel>> is used herein to mean that the first side supporting member 46, 146 and the second side supporting member 48, 148 normally extend parallel to one another, but that parallelism is not essential. Therefore, in an embodiment, one of the side supporting members could present a slight angle with respect to the other side supporting member, thereby diverging from a perfectly parallel alignment. One skilled in the art will understand that the first side supporting member 46, 146 and the second side supporting member 48, 148 may be configured to support the weight of the receptacles 30 received within the receptacle receiving section 51, 151. In an embodiment, the first side supporting member 46, 146 and the second side supporting member 48, 148 are adjacent to an upper section 31 of the heat furnace receptacles 30, on opposite sides thereof.

In the embodiments shown in FIGS. 2 to 5 and 7 to 8, the heat furnace supporting assembly 40, 140 also comprises a top supporting member 44, 144 extending along the longitudinal axis and located at an upper end of the receptacle receiving section 51, 151 and proximal to the top of each receptacle 30 when receptacles 30 are positioned within the receptacle receiving section 51, 151. The top supporting member 44, 144 extends above the receptacles 30 received in the receptacle receiving section 51, 151, at the upper end of the receptacle receiving section 51, 151.

In the embodiments shown in FIGS. 2 to 5 and 7 to 8, the heat furnace supporting assembly 40, 140 further comprises a bottom supporting member 50, 150 located at a lower end of the receptacle receiving section 51, 151 and extending along the longitudinal axis. The bottom supporting member 50, 150 abuts the bottom of each receptacle 30 when receptacles 30 are positioned within the receptacle receiving section 51, 151, and consequently supports their weight.

Figure 4:
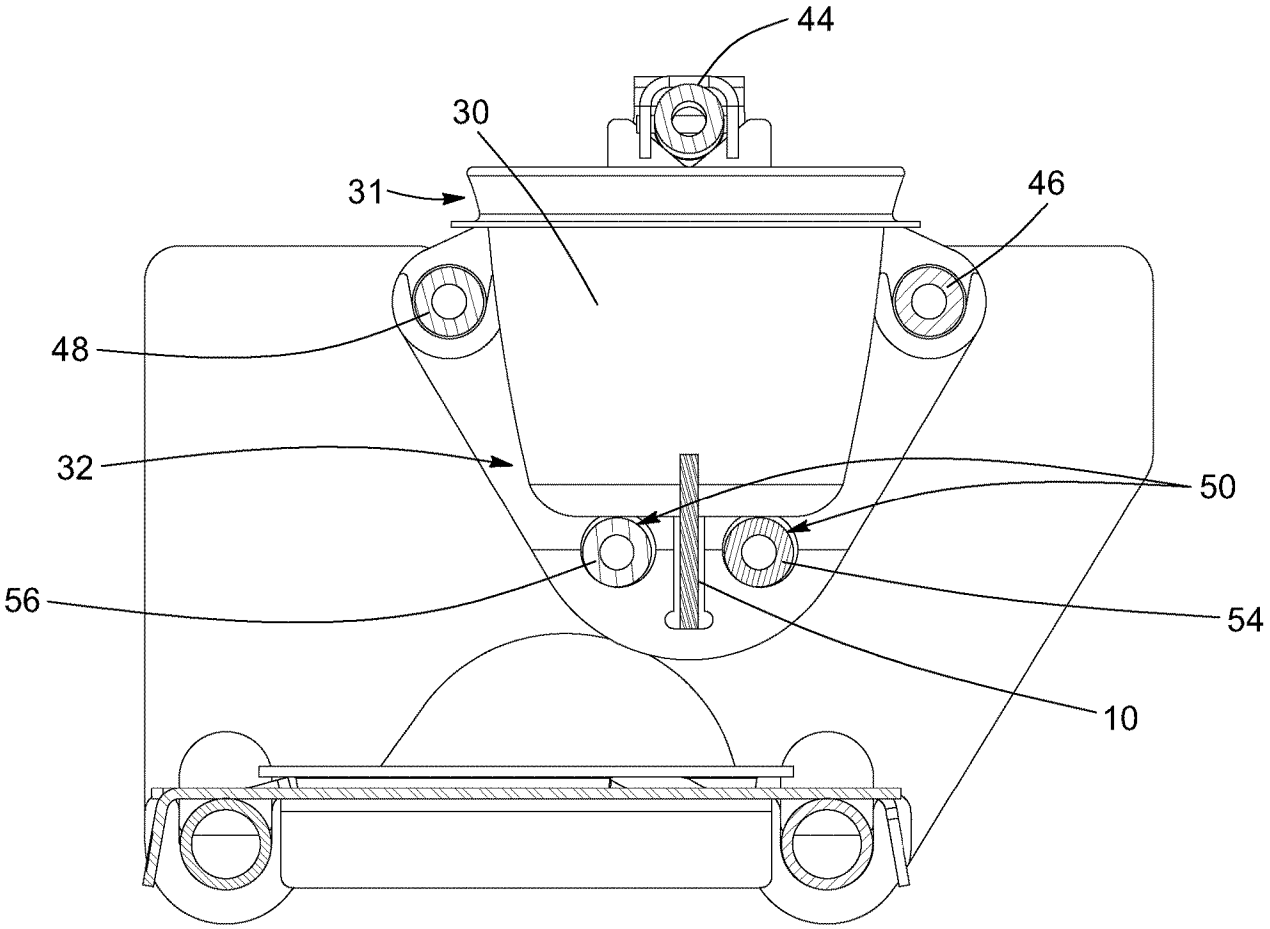
FIG. 4 is a sectional view taken along the line 4-4 in FIG. 3.

Referring to FIG. 4, in an embodiment the bottom supporting member 50 is embodied by a first supporting bar 54 and a second supporting bar 56 substantially parallel to one another and evenly leveled. Dual bottom supporting bars 54, 56 allow the flexural stress imposed by the weight of the receptacles 30 to be shared between the first supporting bar 54 and the second supporting bar 56, therefore reducing the flexural stress on each supporting bar. In the illustrated embodiment, the retaining bar 10 extends between the first supporting bar 54 and the second supporting bar 56. The above mentioned configuration of the supporting assembly 40 is less prone to premature failure of the bottom supporting member 50 (embodied by the first supporting bar 54 and the second supporting bar 56) due to the effects of creep.

One skilled in the art will understand that, in an embodiment and as can be seen in FIG. 8, the bottom supporting member 150 of the heat furnace supporting assembly 140 could be made of a single supporting bar. Evidently, in order for a single bar to resist to the flexural stress imposed thereon, the bar may be required to have a larger cross-section than when multiple bars are provided. Similarly, in an alternative embodiment (not shown), more than two supporting bars could compose the bottom supporting member 50, 150.

Finally, again referring to FIGS. 2 to 5 and 7 to 8, the heat furnace supporting assembly 40, 140 comprises the retaining bar 10, 110 which can be located above or below the receptacle receiving section 51, 151 and extends along the longitudinal axis. The retaining bar 10, 110, comprises all of the above described characteristics to provide longitudinal support to the receptacles 30 located within the receptacle receiving section 51, 151.

Referring for example to FIGS. 7 and 8, even though, the retaining bar 110 is presented above as a distinct element from the top supporting member 144, one skilled in the art will understand that, in an embodiment, the top supporting member 144 could be embodied by the retaining bar 110. In other words, the heat furnace support assembly 140 can be provided with a bottom supporting member 150 at the lower end of the receptacle receiving section 151 and the retaining bar 110 at the upper end thereof. In such an embodiment, the receptacle receiving cavities 114 of the retaining bar 110 are designed and configured to receive therein an upper section 31 of the receptacles 30 supported by the heat furnace supporting assembly 140.

In an embodiment (not shown), the retaining bar, may also act as the bottom supporting member. In other words, the heat furnace support assembly can be provided with a top supporting member at an upper end of the receptacle receiving section and the retaining bar at a lower end thereof. In such an embodiment, the retaining bar would be the element supporting the receptacles from below in the heat furnace supporting assembly. It will be understood, that in this alternative embodiment, the cross-section of the retaining bar could need to be greater to provide the necessary structural strength. Moreover, in this alternative embodiment, a single retaining bar having the above-mentioned characteristics could be provided, or multiple retaining bars having the above-mentioned characteristics could share the flexural stress imposed by the weight of the receptacles. If multiple retaining bars are provided, the multiple retaining bars could be substantially parallel, evenly leveled, and be configured such that their receptacle receiving cavities are aligned with one another.

As previously mentioned, in an alternative embodiment (not shown), the retaining bar, could be made of a plurality of juxtaposed bars, extending substantially parallel to one another, evenly leveled, and configured such that their receptacle receiving cavities, are aligned, or in register, with one another. In an embodiment where the bottom supporting member 50 is embodied by a first supporting bar 54 and a second supporting bar 56 (see FIG. 4), the plurality of juxtaposed bars could be located between the first supporting bar 54 and the second supporting bar 56, or the first supporting bar 54 and the second supporting bar 56 could be between the juxtaposed bars forming the retaining bar 10.

As can be seen more clearly in FIGS. 2 and 3, in an embodiment where the retaining bar 10 is provided under the receptacles 30, the bottom wall 20 of each receptacle receiving cavity 14 of the retaining bar 10 may be located below the upper surface of the bottom supporting member 50 such that the receptacles 30 are spaced-apart from the bottom wall 20 and none of the weight of the receptacles 30 imposes flexural stress on the retaining bar 10. All of the weight of the receptacles 30 is supported by the bottom supporting member 50. Since no flexural stress is imposed on the retaining bar 10, the retaining bar 10 can be a thin bar, the resulting low flexural strength not being an issue. The retaining bar 10 only limits longitudinal displacement of the receptacles 30 received in the receptacle receiving section 51.

In the illustrated embodiments, all of the supporting members of the heat furnace supporting assembly 40 are elongated rounded rods made of a material that can resist the effects of creep and thermal stress, as was previously discussed in relation with the material of the retaining bar 10. Once again, possible materials comprise materials composed of ceramics such as alumina ($Al_2O_3$) and zirconium ($ZrO_2$), but are not limited to these materials. One skilled in the art will however understand that other configurations than a rounded rod may be provided for the supporting members of the heat furnace supporting assembly 40.

In an embodiment, the heat furnace supporting assembly 40 further comprises at least one attachment plate for mounting an end of the above described components thereon. The at least one attachment plate is pivotal, in order to allow the pivoting of the heat furnace supporting assembly 40.

Figure 2:
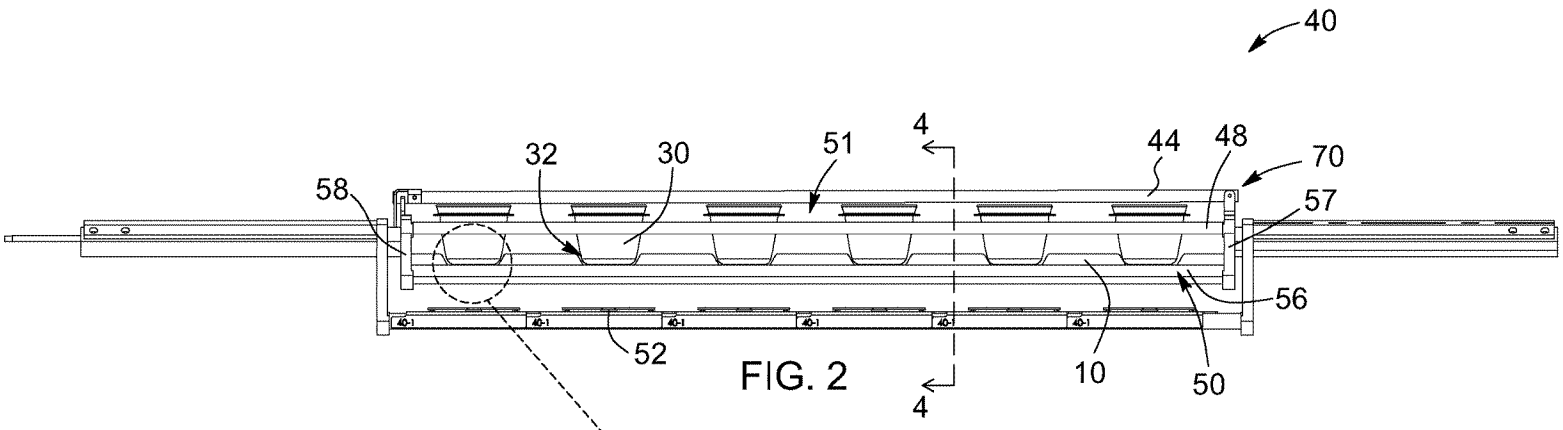
FIG. 2 is a front elevation view of a heat furnace supporting assembly including the retaining bar shown in FIG. 1, in accordance with an embodiment where the components are supported at a first end and a second end and the retaining bar is provided below the heat furnace receptacles.
Figure 5:
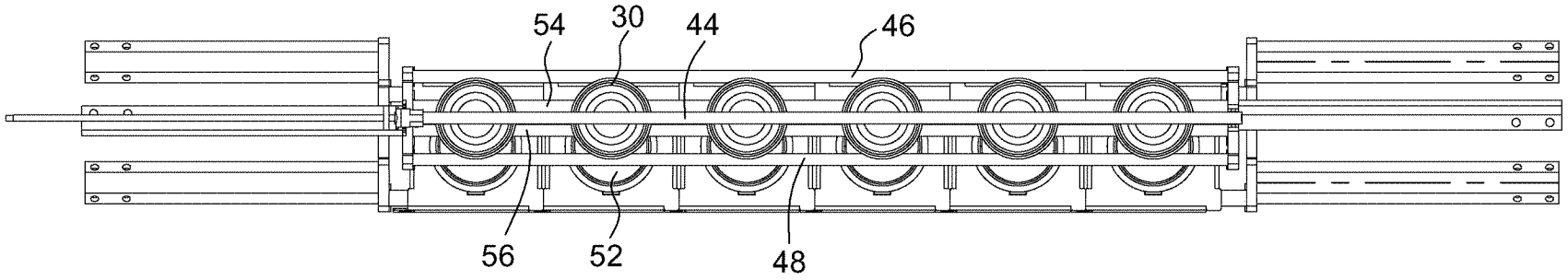
FIG. 5 is a top plan view of the heat furnace supporting assembly of FIG. 2.

In an embodiment, and as can be seen in FIGS. 2 and 5, the components of the heat furnace supporting assembly 40, including the top supporting member 44, the first side supporting member 46, the second side supporting member 48, the bottom supporting member 50 and the retaining bar 10 in the illustrated embodiment, can be supported between a first attachment plate 57 at a first end and a second attachment plate 58 at a second opposite end.

In the embodiment shown, in FIGS. 7 and 8, the components of the supporting assembly 140, including the first side supporting member 146, the second side supporting member 148, the bottom supporting member 150 and the retaining bar 110 also embodying the top supporting member 144 in the illustrated embodiment, can be connected to a single attachment plate 159 at a first end thereof. In such an embodiment, the components of the heat furnace supporting assembly 140 extend from the single attachment plate 159 in a cantilever configuration. Even though the illustrated embodiment of FIGS. 7 and 8 present a configuration for the support of a single receptacle 30, one skilled in the art will understand that a heat furnace supporting assembly 140 for multiple receptacles 30 may also be provided in such an embodiment.

Mounting of the above described components on the single attachment plate 159 (FIGS. 7 and 8) or between the first attachment plate 57 and the second attachment plate 58 (FIGS. 2 to 5) allows all components of the heat furnace supporting assembly 40, 140 to pivot simultaneously as a unitary assembly.

As can be seen in FIGS. 2 and 7, in an embodiment, the top supporting member 44, 144 is connected to the first attachment plate 57, the second attachment plate 58 or the single attachment plate 159 by a hinge 70, 170 in order to allow the top supporting member 44, 144 to be pivoted upwardly to allow insertion of receptacles 30 in the receptacle receiving section 51, 151 and subsequently be pivoted downwardly proximal to the top of the receptacles 30 received in the receptacle receiving section 51, 151. In an alternative embodiment, the top supporting member 44, 144, including or not the retaining bar 10, 110, can be detachably securable to the first attachment plate 57, the second attachment plate 58 or the single attachment plate 159.

As will be understood by one skilled in the art, the support members of the heat furnace supporting assembly 40 constrain the displacement of the receptacles 30 received in the receptacle receiving section 51 at least one of vertically and laterally, while the receptacle receiving cavities 14 of the retaining bar 10 constrain the displacement of the receptacles 30 received in the receptacle receiving section 51 along the longitudinal axis.

Indeed, the heat furnace supporting assembly 40 limits displacement of the receptacles 30 received in the receptacle receiving section 51 along three orthogonal axes. In the illustrated embodiments, the displacement of the receptacles 30 along the longitudinal axis is limited by the receptacles receiving cavities 14 defined in the retaining bar 10. As mentioned above, the retaining bar 10 can be either positioned below or above the receptacles 30. The lateral displacement of the receptacles 30 is limited by the first side supporting member 46 and the second side supporting member 48 extending longitudinally and adjacent to the peripheral wall of the receptacles 30. The vertical displacement of the receptacles 30 is limited by the top supporting member 44 and the bottom supporting member 50, with one of them including the retaining bar 10. Therefore, the heat furnace supporting assembly 40 constrains movement of each receptacle 30 along all three of their possible movement axes.

Figure 6:
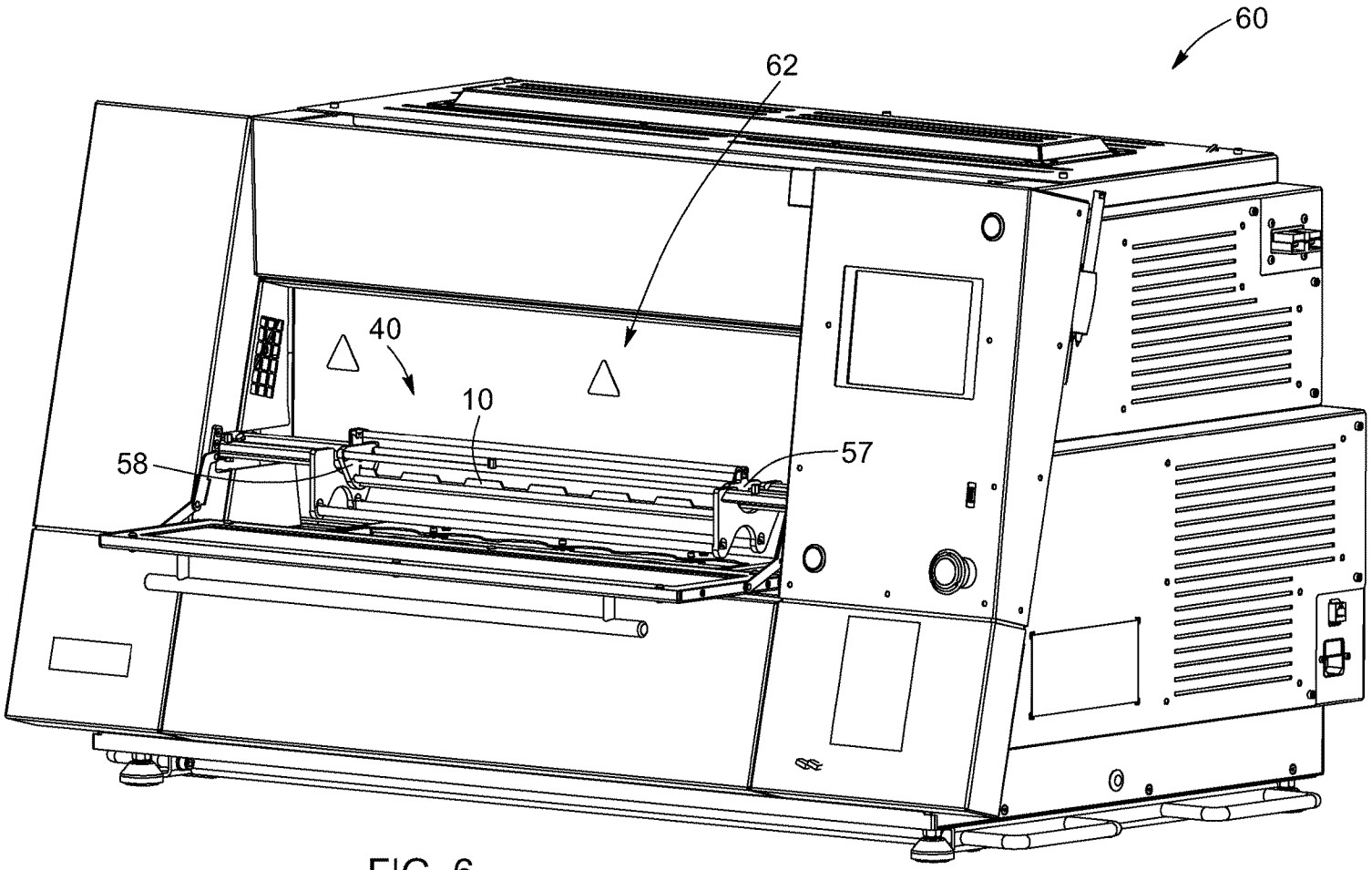
FIG. 6 is a perspective view of a heat furnace, with the heat furnace supporting assembly of FIG. 2, in accordance with an embodiment.

Now referring to FIG. 6, the retaining bar 10 and the supporting assembly 40 comprising the retaining bar 10 are designed to be used into the heating chamber 62 of a heat furnace 60, such as a fluxer, in order to heat a sample contained in the receptacles to a precise temperature, generally over 1000° Celsius. The supporting assembly 40 is pivotally mounted to the heat furnace 60 such that it can pivot inside the heating chamber in order to provide a rocking movement during the heating process as well as pouring of the content of the receptacles into the molds when the content has reached the desired temperature.

One skilled in the art will understand that the heat furnace supporting assembly 40, may be mounted in the heat furnace 60 according to the configuration shown in FIG. 6, where the supporting members of the supporting assembly 40 are mounted between a first attachment plate 57 and a second attachment plate 58, or according to a cantilever configuration such as the one shown in FIGS. 7 and 8, where the supporting members of the heat furnace supporting assembly 140 are connected to a single attachment plate 159 at a first end.

The first attachment plate 57 and the second attachment plate 58, or the single attachment plate 159 is/are pivotally mounted to the heat furnace 60. Therefore, in response to a pivoting movement imparted by the heat furnace 60 on the first attachment plate 57 and the second attachment plate 58 or the single attachment plate 159, the receptacles 30 located within the heat furnace supporting assembly 40 pivot simultaneously. It will be understood that other configurations resulting in the simultaneous movement of the receptacles 30 in response to the movement of the heat furnace supporting assembly 40 could also be provided.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the spirit of the invention. The scope of the invention is therefore intended to be limited solely by the scope of the appended claims.

The invention claimed is:

1. A heat furnace receptacle supporting assembly extending along a longitudinal axis for receiving at least one receptacle having a bottom section, a peripheral wall, and an upper section, the heat furnace receptacle supporting assembly comprising:

a first side supporting member and a second side supporting member extending along the longitudinal axis and being spaced-apart from one another to receive the at least one receptacle therebetween; and at least one retaining bar located between the first side supporting member and the second side supporting member and extending along the longitudinal axis, the combination of the at least one retaining bar, the first side supporting member and the second side supporting member defining a receptacle receiving section, each one of the at least one retaining bar comprising a single piece elongated body with at least one receptacle receiving cavity defined therein adapted to receive one of the bottom section and the upper section of a respective one of the at least one receptacle received in the receptacle receiving section with the first side supporting member and the second side supporting member being adjacent to the peripheral wall of the at least one receptacle received in the receptacle receiving section.

2. The heat furnace receptacle supporting assembly of claim 1, wherein the at least one retaining bar extends below the first side supporting member and the second side supporting member.

3. The heat furnace receptacle supporting assembly of claim 2, wherein the at least one retaining bar is located below the at least one receptacle received in the receptacle receiving section.

4. The heat furnace receptacle supporting assembly of claim 2, further comprising a top supporting member extending along the longitudinal axis above the first side supporting member and the second side supporting member and defining therewith the receptacle receiving section, the top supporting member extending above the at least one receptacle received in the receptacle receiving section.

5. The heat furnace receptacle supporting assembly of claim 2, further comprising at least one bottom supporting member extending along the longitudinal axis and below the at least one receptacle received in the receptacle receiving section.

6. The heat furnace receptacle supporting assembly of claim 5, wherein the bottom section of the at least one receptacle received in the receptacle receiving section rests on the at least one bottom supporting member and is spaced apart from a bottom wall of a corresponding receptacle receiving cavity of the at least one retaining bar, the at least one retaining bar constraining longitudinal displacement of the at least one receptacle received therein.

7. The heat furnace receptacle supporting assembly of claim 1, wherein the at least one retaining bar extends above the first side supporting member and the second side supporting member and wherein the supporting assembly further comprises at least one bottom supporting member extending along the longitudinal axis below the first side supporting member and the second side supporting member and defining therewith the receptacle receiving section, the bottom section of the at least one receptacle received in the receptacle receiving section resting on the at least one bottom supporting member.

8. The heat furnace receptacle supporting assembly of claim 1 further comprising at least one pivotal attachment plate to which the first side supporting member, the second side supporting member, and the at least one retaining bar are connected at an end thereof and pivoting of the at least one attachment plate simultaneously pivots the first side supporting member, the second side supporting member, and the at least one retaining bar.

9. The heat furnace receptacle supporting assembly of claim 8, wherein the at least one pivotal attachment plate comprises two pivotal attachment plates, spaced-apart from one another, with the first side supporting member, the second side supporting member, and the at least one retaining bar extending therebetween and having an end operatively connected to a respective one of the two pivotal attachment plates, the two pivotal attachment plates pivoting simultaneously.

10. A heat furnace for heating a sample contained in at least one receptacle having a bottom section and an upper section, the heat furnace comprising:

a heating chamber; and a receptacle supporting assembly extending in the heating chamber along a longitudinal axis and comprising:

at least two supporting members extending along the longitudinal axis and spaced apart from one another, the at least two supporting members defining a receptacle receiving section and constraining displacement of the at least one receptacle received in the receptacle receiving section at least one of vertically and laterally; and a retaining bar extending along the longitudinal axis and having a single piece elongated body with at least one receptacle receiving cavity defined therein, each one of the at least one receptacle receiving cavity being configured to constrain longitudinal displacement of a corresponding one of the at least one receptacle by receiving therein one of the bottom section and the upper section of the corresponding receptacle.

11. The heat furnace of claim 10, wherein the receptacle supporting assembly further comprises at least one attachment plate pivotally mounted in the heating chamber, the at least two supporting members and the retaining bar being connected to the at least one attachment plate at an end thereof.

12. The heat furnace of claim 11, wherein the at least one attachment plate is a single pivotable attachment plate and the receptacle supporting assembly is configured in a cantilever configuration.

13. The heat furnace of claim 11, wherein the at least one attachment plate comprises two pivotable attachment plates spaced-apart from one another, with the at least two supporting members and the retaining bar extending therebetween and having an end operatively connected to a respective one of the two pivotal attachment plates, the two pivotal attachment plates pivoting simultaneously in the heating chamber.

14. The heat furnace of claim 10, wherein the at least two supporting members comprise a first side supporting member and a second side supporting member, spaced-apart from one another, and extending longitudinally adjacent to a peripheral wall of the at least one receptacle received in the receptacle receiving section.

15. The heat furnace of claim 14, wherein the at least two supporting members further comprise at least one bottom supporting member extending below the first side supporting member and the second side supporting member, at a lower end of the receptacle receiving section.

16. The heat furnace of claim 15, wherein the retaining bar extends at the lower end of the receptacle receiving section and the bottom section of the at least one receptacle received in the receptacle receiving section rests on the at least one bottom supporting member and is spaced apart from a bottom wall of a corresponding receptacle receiving cavity of the retaining bar, the retaining bar constraining longitudinal displacement of the at least one receptacle received therein.

17. The heat furnace of claim 14, wherein the at least two supporting members further comprise a top supporting member extending above the first side supporting member and the second side supporting member, at an upper end of the receptacle receiving section.

18. The heat furnace of claim 10, wherein the retaining bar is located at the lower end of the receptacle receiving section.

19. The heat furnace of claim 10, wherein the retaining bar is located at an upper end of the receptacle receiving section.

* * * * *